United States Patent [19]

Inoue et al.

[11] Patent Number: 4,938,618

[45] Date of Patent: Jul. 3, 1990

[54] METHOD AND APPARATUS FOR SETTING PAPER ON A PRINTER

[75] Inventors: Haruo Inoue; Yoshiaki Miyauchi; Hidetoshi Kodama, all of Tokyo, Japan

[73] Assignee: Seikosha Co., Ltd., Tokyo, Japan

[21] Appl. No.: 267,609

[22] Filed: Nov. 7, 1988

[30] Foreign Application Priority Data

Nov. 6, 1987 [JP] Japan ..... 62-280613

[51] Int. Cl.[5] ..... B41J 13/10

[52] U.S. Cl. ..... 400/642; 400/624; 400/645

[58] Field of Search ..... 400/642, 624, 655, 656, 400/248, 625, 645

[56] References Cited

U.S. PATENT DOCUMENTS 4,744,687 5/1988 Nukaya et al. ..... 400/624
4,802,778 2/1989 Takahashi et al. ..... 400/624

FOREIGN PATENT DOCUMENTS 48609 9/1986 Japan ..... 400/356
242865 10/1986 Japan ..... 400/642
35863 2/1987 Japan ..... 400/642

*Primary Examiner*—Edgar S. Burr
*Assistant Examiner*—Joseph R. Keating
*Attorney, Agent, or Firm*—Jordan and Hamburg

[57] ABSTRACT

In a method for setting paper on a printer wherein a paper guide having an extending portion extending parallel to a platen is provided opposite to the platen on a printing head reciprocating in parallel with the platen, the paper guide having an opening for exposing an ink ribbon at a position opposite a nose portion of the printing head to provide for printing on a paper inserted between the printing head and the platen, the method including the steps of placing the printing head at a position where the extending portion of the paper guide faces the paper and the opening in the paper guide is displaced away from the paper, feeding the paper between the extending portion and the platen to a position where an upper side of the paper passes beyond the opening, shifting the printing head to substantially a central portion of the cut paper, and thereafter feeding the paper to a printing start position.

1 Claim, 3 Drawing Sheets

METHOD AND APPARATUS FOR SETTING PAPER ON A PRINTER

BACKGROUND OF THE INVENTION

This invention relates to a method and apparatus for setting paper on a printer.

Prior art printers include various types wherein a paper guide opposite to a platen is provided on a printing head reciprocating parallel to the platen. An opening for exposing an ink ribbon is formed at a position of the paper guide opposite to a nose portion of the printing head, and the paper guide has a shape which is almost the same in width as the printing head and generally symmetrical horizontally.

As one example of the setting method for cut paper on a printer of such construction, the printing head is shifted to a position almost at the center of the cut paper, the cut paper is then inserted between the printing head and the platen and fed as far as it goes to a printing start position.

However, according to the aforementioned setting method, the printing head is positioned opposite to the central portion of the cut paper while the cut paper is fed as far as the printing start position after insertion, and the ink ribbon exposed through the opening in the paper guide is opposite to the cut paper. Consequently, there is a disadvantage in that when the cut paper is inserted, an upper side of the cut paper is brought into contact with an exposed portion of the ink ribbon to thereby stain the paper.

Accordingly, an object of the present invention is to prevent a cut paper from being stained when the cut paper is set on a printer.

SUMMARY OF THE INVENTION

In a setting method and apparatus for cut paper on a printer, wherein a paper guide having an extending portion extending parallel to a platen is provided opposite to a platen on a printing head reciprocating in parallel with the platen, and an opening for exposing an ink ribbon is formed on the paper guide at a position opposite to a nose portion of the printing head to provide for printing on a cut paper inserted between the printing head and the platen, and printing head is placed at a position where the extending portion of the paper guide faces the cut paper and the opening is displaced away from the cut paper, the cut paper is fed between the extending portion and the platen as far as a position where an upper side or upper end of the cut paper passes the opening, the printing head is then shifted nearly to a central portion of the cut paper, and thereafter the cut paper is fed to a printing start position.

DESCRIPTION OF THE PREFERRED EMBODIMENTS

Figure 1:
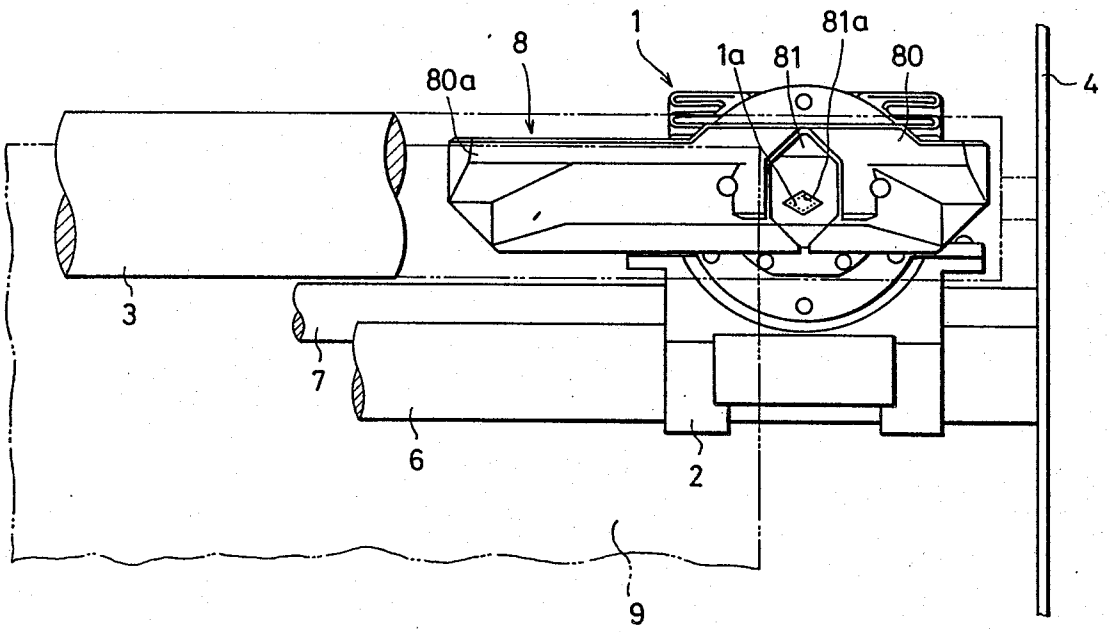
FIG. 1 is a front view, partly cut away, showing the relationship between a paper guide and a cut paper when a printing head is placed in a home position.
Figure 2:
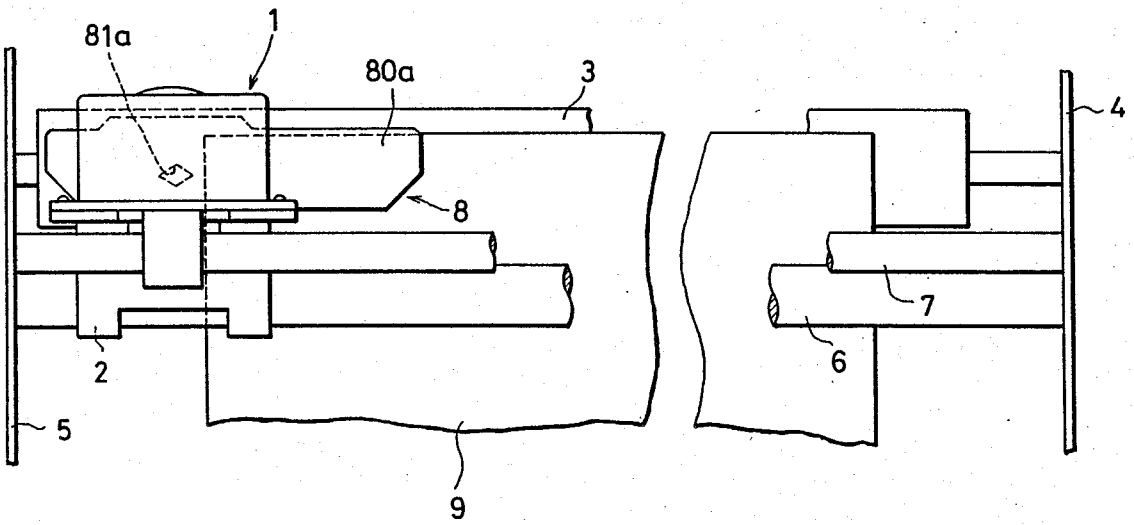
FIG. 2 is a rear elevation, partly cut away, showing a state when the cut paper is carried to a position beyond an opening.
Figure 3:
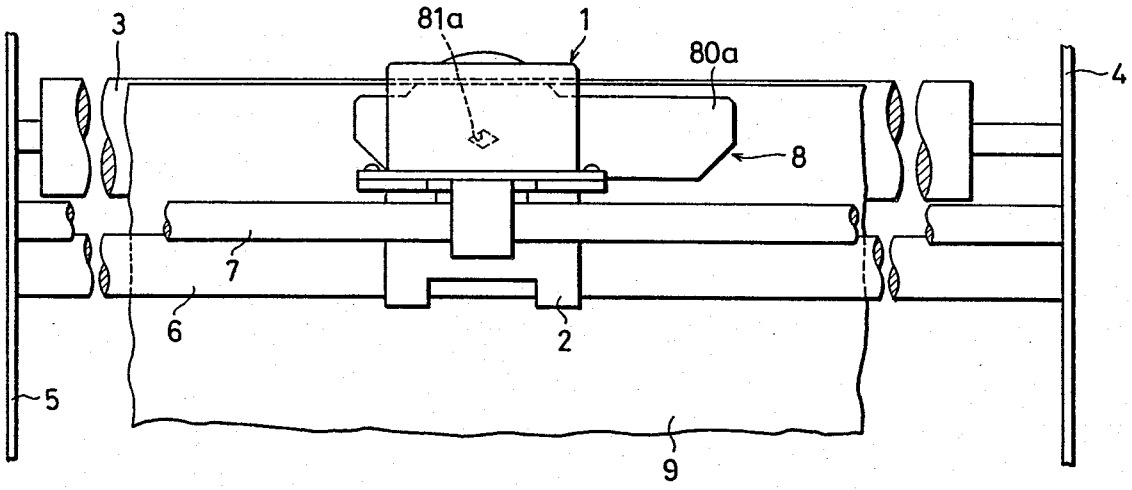
FIG. 3 is a rear elevational view, partly cut away, showing a state where the cut paper is carried to a printing start position.

FIGS. 1, 2 and 3 show a printing head 1 disposed on a carriage 2 opposite to a platen 3. The carriage 2 is slidably mounted on guide shafts 6, 7 extending between side plates 4, 5 and disposed parallel to the platen 3. The printing head 1 is reciprocated together with the carriage 2 and in parallel with the platen 3 through a non-illustrated driving mechanism. As shown in FIG. 1, a printing part 1*a* is formed on a nose portion of the printing head 1 and a paper guide 8 is provided on the printing head 1 opposite to the platen 3. The paper guide 8 consists of a synthetic resin guide plate 80, a ribbon mask 81 formed of a thin metallic sheet, and an opening 81*a* for exposing a non-illustrated ink ribbon formed at a position where the ribbon mask 81 faces the printing part 1*b*. An extending portion 80*a* extending opposite to and in parallel with the platen 3 is formed on the guide plate 80. A cut paper 9 is fed between the printing head 1 and the platen 3 by a non-illustrated cut paper feeding mechanism.

A description of the operation of setting the cut paper 9 follows. Before inserting the cut paper 9, the printing head 1 is first placed in a home position shown in FIG. 1 and FIG. 2. Thereafter, with the printing head 1 maintained in the home position, the cut paper 9 is inserted between the printing head 1 and the platen 3, and then fed to a position where an upper side or upper end of the cut paper 9 passes the opening 81*a*, or passes near to an upper side portion of the guide plate 80 as shown by broken lines in FIG. 1. In this case, since the cut paper 9 is not opposite to the opening 81*a*, it will not come into contact with a non-illustrated ink ribbon exposed through the opening 81*a*, and thus the paper will never be stained as the paper is fed and guided by the extending portion 80*a*. Thereafter, the printing head 1 is shifted nearly to the center of the cut paper 9, as shown in FIG. 3, and the paper guide 8 is thereby placed in a position opposite to the central portion of the cut paper 9. Then the cut paper 9 is fed as far as it goes to a printing start position, as shown in FIG. 3. In this case, the paper guide 8 guides the central portion of the cut paper 9 along its entire width, such that a deviation of the paper will not occur as a result of the sliding resistance between the paper guide 8 and the cut paper 9, and the cut paper 9 will not become inclined during its feed.

In the above-described embodiment, the position for feeding the cut paper 9 is set to a position where the cut paper 9 faces the extending portion 80*a* and is kept away from the opening 81*a* when the printing head 1 is in its home position; however, the position for feeding the cut paper 9 may be set otherwise at the center of the shift range of the printing heat 1, and the printing head 1 may be shifted to a position where the cut paper 9 faces the extending portion 80*a* and is kept away from the opening 81*a* when the cut paper 9 is fed. Further, the position where the cut paper 9 is fed while being kept away from the opening 81*a* may be that at which an upper side or upper end of the cut paper 9 passes an upper edge portion of the opening 81*a*, and the upper side of the cut paper 9 may be positioned near an intermediate portion of the paper guide 8 if the upper side of the cut paper 9 passes an upper edge portion of the opening 81*a*. Then, the guide plate 80 and the ribbon mask 81 may be formed integrally of synthetic resin or of a metallic sheet or the like. Needless to say, the invention is applicable not only to a printer on which a cut paper is used exclusively but also to a printer on which a continuous paper and a cut paper can both be used selectively.

As described in detail above, according to the setting method for cut paper of the present invention, an inserted cut paper is fed while being guided by the extending portion of a paper guide as far as a position where it passes an opening through which an ink ribbon is exposed without facing the ink ribbon exposed through the opening of the paper guide. Thereafter, the cut paper is further fed and guided by the paper guide in its entirety after being shifted to a position opposite to a central portion of the cut paper as far as a printing start position from the position away from the opening. Therefore, a stain will not result on the cut paper at the time of setting, and the cut paper will remain straight without becoming inclined.

We claim:

1. A method for setting paper on a printer having a cylindrical platen rotatable to feed paper, a printing head disposed opposite said platen and reciprocated along said platen in a direction transverse to a paper feeding direction, a paper guide carried on a front portion of said printing head so as to oppose said platen, said printing head having a nose portion, said paper guide having an opening positioned opposite said nose portion, an ink ribbon exposed in said opening, said paper guide having guide portions extending laterally from both sides of said opening, comprising the steps of:

moving said printing head to a first position adjacent to an end of said platen;

feeding said paper substantially tangentially of said platen while said printing head remains in said first position, said paper having a lateral edge engaged by one of said guide portions of said guide while said lateral edge is spaced laterally away from said opening and between said opening and the other end of said platen to thereby prevent contact of said paper with said opening;

continuing the last said feeding step with said printing head remaining in said first position until an uppermost edge of said paper has been fed to and past the level of said opening;

shifting said printing head to a second position located at a central portion of said platen so that the entire paper guide engages said paper; and feeding said paper substantially tangentially of said platen between said paper guide and platen to a printing start position to form a desired top margin on said paper while maintaining said printing head in said second position.

* * * * *